US005875961A

United States Patent [19]

Stone et al.

[11] Patent Number: 5,875,961

[45] Date of Patent: Mar. 2, 1999

[54] NON-DIRECTIONAL PAPERBOARD POUR SPOUT

[75] Inventors: James L. Stone, Grand Rapids; David F. Gnadt, Grandville, both of Mich.

[73] Assignee: Tenneco Packaging, Evanston, Ill.

[21] Appl. No.: 898,378

[22] Filed: Jul. 22, 1997

Related U.S. Application Data

[63] Continuation-in-part of Ser. No. 867,601, Apr. 21, 1997, Pat. No. 5,810,250.

[51] Int. Cl.[6] ..... B65D 5/74

[52] U.S. Cl. ..... 229/215; 229/221; 493/69; 493/79; 493/128

[58] Field of Search ..... 229/125.42, 160.2, 229/207, 215, 221; 222/541.5, 541.6, 541.9; 493/69, 70, 79, 80, 128, 151

[56] References Cited

U.S. PATENT DOCUMENTS

| | | | |
|---|---|---|---|
| 742,271 | 10/1903 | Allen | 222/565 |
| 939,825 | 11/1909 | Frank | 229/242 |
| 1,367,379 | 2/1921 | Gruenberg | 229/240 |
| 2,166,222 | 7/1939 | Ranko et al. | 222/565 |
| 2,543,084 | 2/1951 | Williamson et al. | 229/242 |
| 2,885,933 | 5/1959 | Phillips . | |
| 2,903,175 | 9/1959 | Peimer . | |
| 3,133,689 | 5/1964 | Rossi . | |
| 3,184,137 | 5/1965 | Mohler . | |
| 3,185,377 | 5/1965 | Moore . | |
| 3,187,977 | 6/1965 | Graybill . | |
| 3,187,978 | 6/1965 | Graybill . | |
| 3,289,913 | 12/1966 | Svensson . | |
| 3,344,972 | 10/1967 | Robinson et al. . | |
| 3,362,612 | 1/1968 | Mohler . | |
| 3,568,910 | 3/1971 | McConnell . | |
| 3,570,743 | 3/1971 | Mohler | 229/215 |
| 4,317,518 | 3/1982 | Mode . | |
| 4,809,853 | 3/1989 | Weber . | |
| 4,852,764 | 8/1989 | Stone | 220/315 |
| 4,858,793 | 8/1989 | Stone | 222/541 |
| 4,909,395 | 3/1990 | Weissman . | |
| 4,944,406 | 7/1990 | Zehnal . | |
| 4,967,910 | 11/1990 | Schuster . | |
| 5,014,888 | 5/1991 | Bryan | 222/541 |
| 5,035,330 | 7/1991 | Kuchenbecker . | |
| 5,169,059 | 12/1992 | Desmond et al. | 229/215 |
| 5,259,552 | 11/1993 | Kuchenbecker | 229/207 |
| 5,429,297 | 7/1995 | Walsh | 229/215 |
| 5,439,133 | 8/1995 | Stone . | |
| 5,452,850 | 9/1995 | Allsop | 229/219 |
| 5,531,376 | 7/1996 | Brink et al. | 229/215 |
| 5,582,344 | 12/1996 | Lawson | 229/219 |
| 5,720,430 | 2/1998 | Rowland | 229/215 |
| 5,810,250 | 9/1998 | Stone et al. | 229/221 |

FOREIGN PATENT DOCUMENTS

| | | | |
|---|---|---|---|
| 92953 | 3/1962 | Denmark . | |
| 3832544 | 3/1990 | Germany . | |
| 472474 | 9/1937 | United Kingdom | 229/215 |
| 1275802 | 5/1972 | United Kingdom . | |

*Primary Examiner*—Gary E. Elkins
*Attorney, Agent, or Firm*—Arnold White & Durkee

[57] ABSTRACT

A paperboard container composed of a unitary, continuous blank comprises opposing top and bottom walls, a plurality of side walls bridging the top and bottom walls, and a paperboard pour spout closure. The plurality of side walls includes a first side wall, and a top major flap extends from an upper end of the first side wall and forms a portion of the top wall. A backboard is coupled to the top major flap and includes a plug. The inner surface of the backboard is adhered to the inner surface of the first side wall. A closure layer is formed in the first side wall and is adhered to the plug. The closure layer and the plug form the pour spout closure. The pour spout closure is pivotally coupled to the first side wall for movement between closed and open positions. The plug is detachably linked to a remainder of the backboard. The plug is linked to the backboard when the pour spout closure is initially in the closed position. The plug is detached from the remainder of the backboard and leaves behind a hole in response to opening the pour spout closure. The plug is inserted into the hole in response to reclosing the pour spout closure. The first side wall forms at least one prong adjacent to the closure layer. The prong engages the plug in response to closing the pour spout closure.

25 Claims, 6 Drawing Sheets

NON-DIRECTIONAL PAPERBOARD POUR SPOUT

CROSS REFERENCE TO RELATED APPLICATIONS

This application is a continuation-in-part of U.S. application Ser. No. 08/837,601 filed Apr. 21, 1997 for "A Non-Directional Paperboard Pour Spout" to James L. Stone and Thomas J. Brink, now U.S. Pat No. 5,810,250.

FIELD OF THE INVENTION

The present invention relates generally to paperboard containers and, more particularly, relates to a paperboard container having an integrally formed non-directional paperboard pour spout.

BACKGROUND OF THE INVENTION

Pour spouts are employed on containers to dispense various types of products, including, but not limited to, granular products (e.g., pet litter, laundry detergent, dishwashing detergent, etc.), baking supplies (e.g., flour, pancake mix, sugar, etc.), rice, cereal, dry pet food, and gun pellets. Although metal and plastic pour spouts have been applied to containers for many years, the application of such metal and plastic spouts is costly because the spouts require special and expensive application equipment and cause decreased assembly line efficiencies.

In order to reduce the costs associated with the application of pour spouts to containers, pour spouts composed of paperboard have been introduced to the marketplace in recent years. Heretofore, the effectiveness of such paperboard pour spouts has been limited by such problems as lack of durability, the absence of tactile or audible feedback indicative of positive reclosure, lack of positive recloseability, lack of size to provide adequate pouring, the inability to prevent spillage or sifting of the contents of the container in the area of the pour spout, and the inability to prevent the pour spout from being pushed too far into a package which makes opening more difficult the following time. In addition, paperboard pour spouts have been fairly costly due to their use of excessive amounts of paperboard, thereby making some designs cost prohibitive. Lastly, the location of a paperboard pour spout, especially in those applications involving narrow containers, is important since some existing paperboard pour spouts are not capable of fitting on a narrow side wall.

Accordingly, a need exists for a paperboard pour spout which overcomes the above-noted shortcomings associated with existing pour spouts.

SUMMARY OF THE INVENTION

In one particular embodiment of the present invention, a paperboard container composed of a unitary, continuous blank, comprises opposing top and bottom walls, a plurality of side walls bridging the top and bottom walls, and a non-directional paperboard pour spout closure. The plurality of side walls includes a first side wall having upper and lower ends. A top major flap extends from the upper end of the first side wall, and the top major flap forms a portion of the top wall. A backboard is coupled to the top major flap and includes a plug. An inner surface of the backboard is preferably adhered to an inner surface of the first side wall. An outer closure layer is formed in the first side wall and is adhered to the plug. The outer closure layer and the plug form a pour spout closure. The pour spout closure is pivotally coupled to the first side wall for movement between a closed position and an open position.

The plug is linked to a remainder of said backboard when the pour spout closure is initially in the closed position. The plug is detached from the remainder of the backboard and leaves behind a hole in response to moving the pour spout closure from the closed to the open position. The plug is inserted into the hole in response to moving the pour spout closure from the open to the closed position. The first side wall forms at least one prong adjacent to the closure layer. The prong engages the plug in response to moving the pour spout closure from the open to the closed position.

BRIEF DESCRIPTION OF THE DRAWINGS

Other objects and advantages of the invention will become apparent upon reading the following detailed description and upon reference to the drawings in which.

Figure 1:
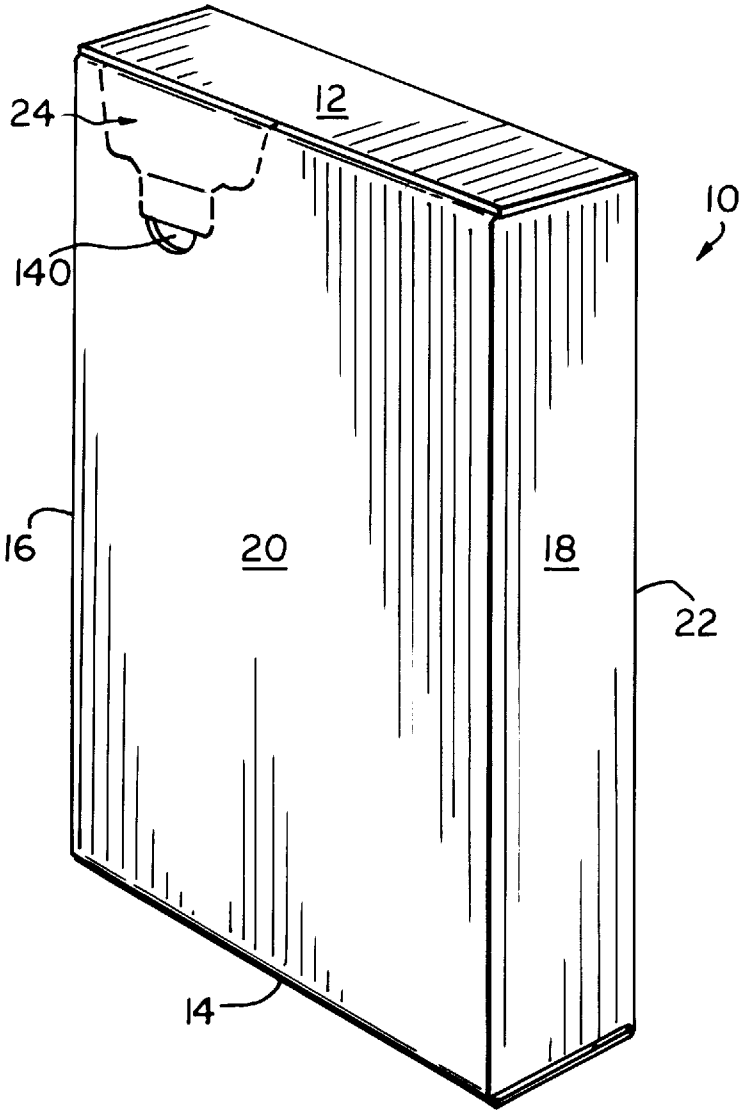
FIG. 1 is a perspective view of a paperboard container embodying the present invention showing a non-directional paperboard pour spout in a closed position.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 8:
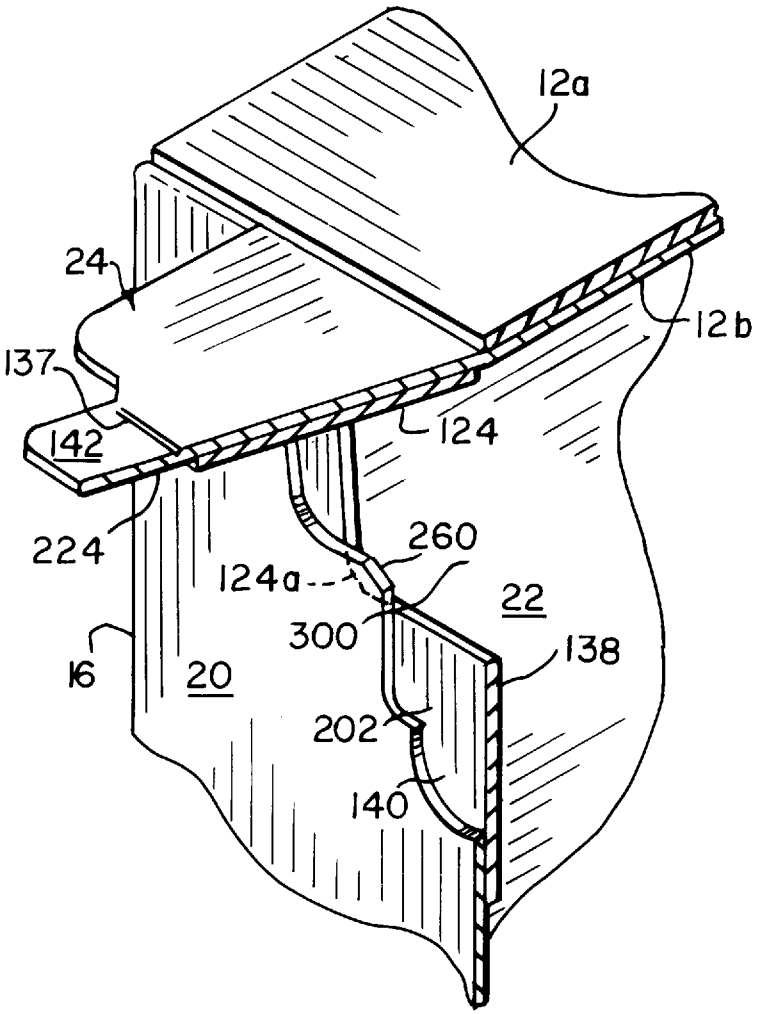
FIG. 8 is a partial isometric cross-sectional view of the paperboard container in FIG. 1 showing the non-directional paperboard pour spout in the open position.
Figure 9:
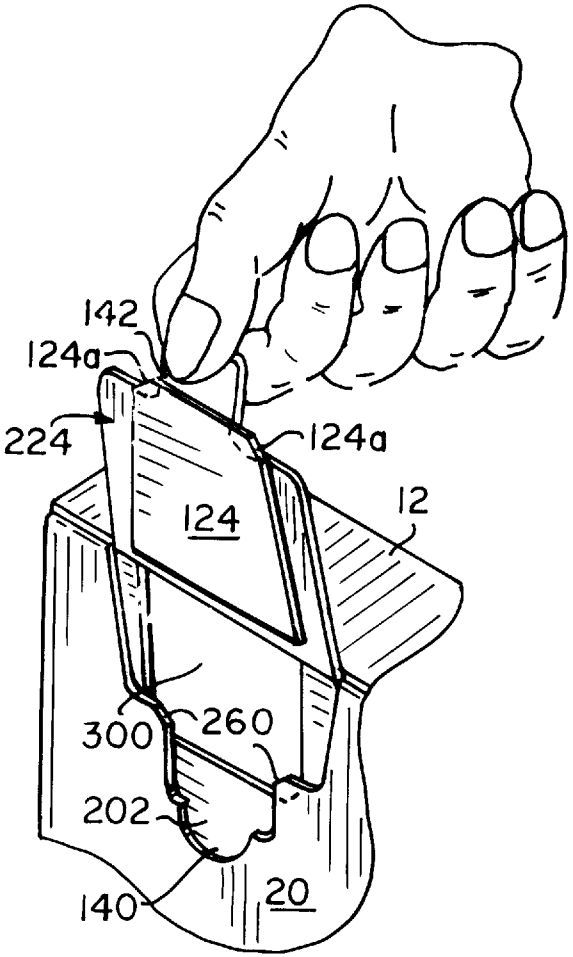
FIG. 9 is a partial isometric view of the paperboard container in FIG. 1 showing a human hand opening the non-directional paperboard pour spout.

Turning now to the drawings, FIG. 1 illustrates a paperboard container 10 formed from a unitary, continuous blank. The container 10 includes opposing top and bottom walls 12 and 14, four side walls 16, 18, 20 and 22 bridging the top and bottom walls 12 and 14, and a pour spout closure 24. The pour spout closure 24 is pivotally mounted to the side wall 20 for movement between a closed position (FIGS. 1, 7 and 10) and an open position (FIGS. 8 and 9).

Figure 2:
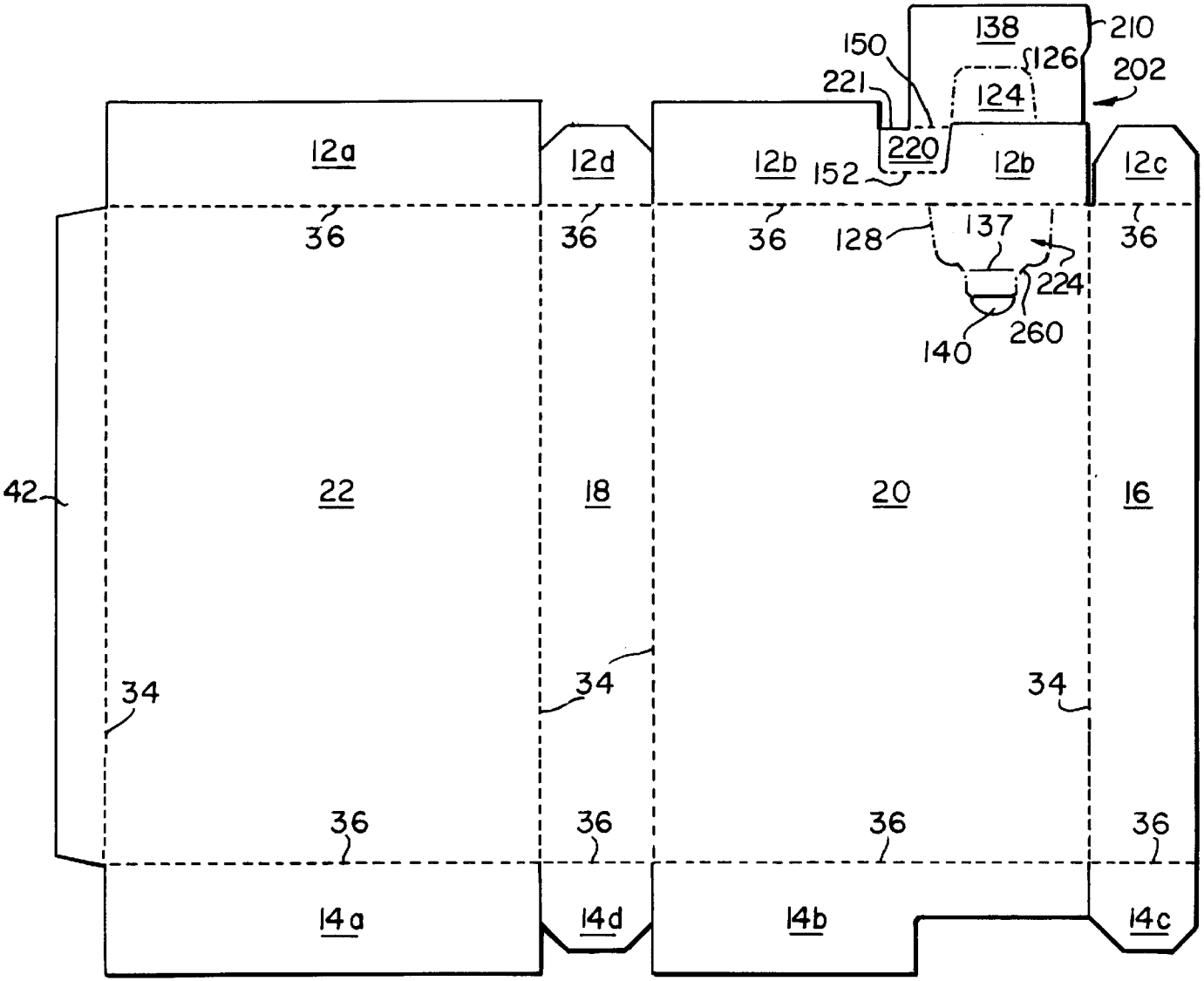
FIG. 2 is a plan view of an inside surface of a unitary, continuous blank used to form the paperboard container in FIG. 1.

FIG. 2 is a plan view of an inside surface of an unitary, continuous blank that can form the paperboard container 10 in FIG. 1. Identical reference numerals are used in FIGS. 1 and 2, as well as the remaining figures, to indicate corresponding portions of the blank and the paperboard container 10. The sheet of paperboard from which the blank is cut preferably has a thickness in a range of from about 0.014 inches to about 0.026 inches. As viewed in FIG. 2, the blank includes four side wall panels 16, 18, 20 and 22 hingedly connected to each other along generally vertical fold lines 34. These side wall panels form the respective side walls of the paperboard container 10 in FIG. 1.

Figure 6:
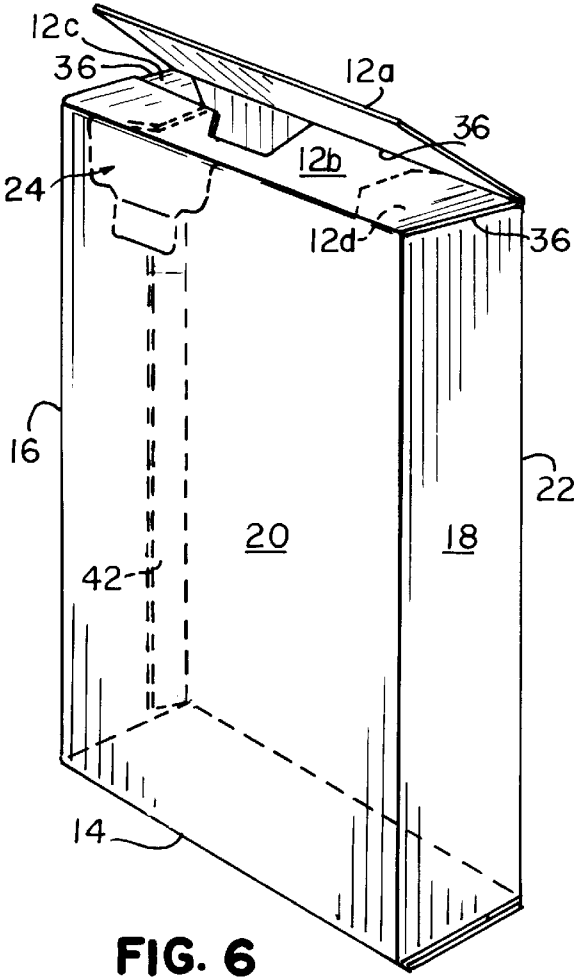
FIG. 6 is a perspective view showing the top closure flaps being folded to form the top wall of the paperboard container in FIG. 1.

A plurality of top and bottom closure flaps are hingedly connected to opposing upper and lower edges of the side wall panels 16, 18, 20 and 22 along generally horizontal fold lines 36. In particular, top major flaps 12*a* and 12*b* are hingedly connected to the upper edges of the respective side walls 22 and 20, and top minor flaps 12*c* and 12*d* are hingedly connected to the upper edges of the respective side walls 16 and 18. The top closure flaps 12*a*, 12*b*, 12*c* and 12*d* fold as shown in FIG. 6 to form the top wall 12 of the paperboard container 10. Similarly, bottom major flaps 14*a* and 14*b* are hingedly connected to the lower edges of the respective side walls 22 and 20, and bottom minor flaps 14*c* and 14*d* are hingedly connected to the lower edges of the respective side walls 16 and 18. The bottom closure flaps 14*a*, 14*b*, 14*c* and 14*d* fold in conventional fashion to form the bottom wall 14 of the paperboard container 10.

Figure 3:
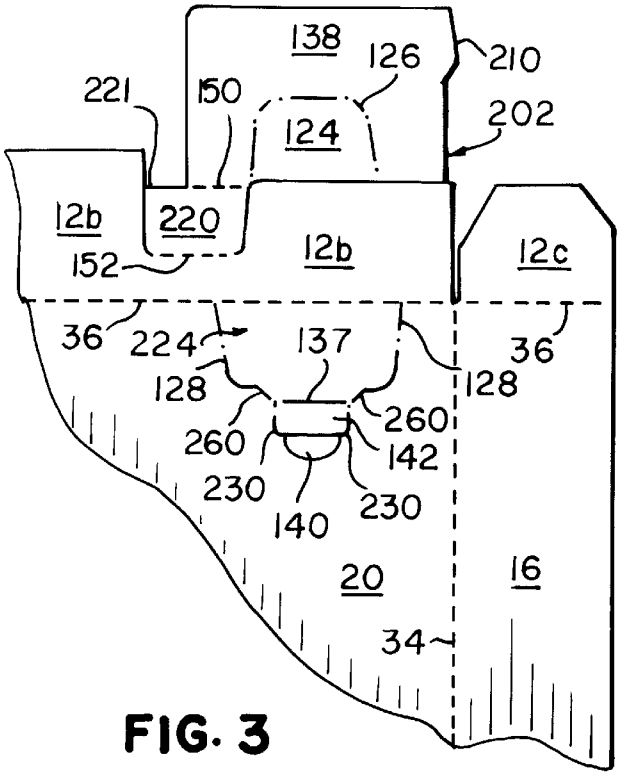
FIG. 3 is an enlarged plan view of a pour spout forming portion of the blank in FIG. 2.

Referring to FIGS. 2 and 3, the blank includes a reinforcing body panel or backboard 202 coupled to the major flap 12*b*. A portion of the backboard 202 forms the pour spout closure 24 of the paperboard container 10 in FIG. 1. The backboard 202 includes a paperboard plug 124 and a generally inverted U-shaped section 138. Paperboard plug 124 is detachably linked to the inverted U-shaped section 138 of the backboard 202 by die-cut lines 126. Die-cut lines 126 contain weakening "nicks" whereby the paperboard plug 124 can be easily separated from the inverted U-shaped section 138. To regulate the amount of force required to break plug 124 free from section 138, the weakening nicks can be varied in size, shape, position and number. These weakening nicks also regulate the amount of "hold" that plug 124 will have upon section 138 when the plug 124 is reinserted to a closed position. The plug 124 may contain a cutout area (not shown) to assist in the form-fill-seal process. The section 138 is hingedly connected to connector panel 220 via a horizontal score line 150. Horizontal score line 150 may be manufactured with cuts therein to facilitate positive folding. The connector panel 220 is hingedly connected to the major flap 12*b* by a horizontal score line 152. The horizontal score line 152 may be slightly skewed or offset to assist in locating a foot 210. To enhance sift resistance, the connector panel 220 is preferably located away from the outer vertical edges of major flap 12*b*.

As viewed in FIGS. 2 and 3, the backboard 202 extends upwardly from the connector panel 220 and the major flap 12*b*. It is contemplated that portions of the major flap 12*b* may be cut away to assist in non-standard folding and gluing of the top flaps on form-fill-seal equipment.

The formation of the backboard 202 by its connection to the top major flap 12*b* is advantageous because it minimizes the amount of paperboard required to form the pour spout closure 24. This paperboard minimization in turn reduces the cost of manufacturing the container 10 of FIG. 1. During the manufacture of the paperboard container 10, several paperboard blanks are simultaneously formed adjacent to one another from a sheet of paperboard. For example, the paperboard blank in FIG. 2 is formed adjacent to a second identical blank which is positioned above (or below) the blank in FIG. 2. If this second identical blank is positioned above the blank in FIG. 2, the lowermost edges of the bottom major flaps of the second blank (akin to flaps 14*a* and 14*b*) are immediately adjacent to the uppermost edges of the top major flaps 12*a* and 12*b* of the blank in FIG. 2.

To minimize the amount of paperboard scrap generated by die-cutting a sheet of paperboard into multiple adjacent blanks, it is desirable for portions of one blank to nest with portions of an adjacent blank. Such nesting occurs when the second identical blank described above is formed immediately above the blank in FIG. 2. Specifically, the backboard 202 is nested within a rectangular area unoccupied by the second blank. This unoccupied rectangular area is akin to the rectangular area immediately below a portion of the bottom major flap 14*b* in FIG. 2. The reduction in paperboard scrap resulting from the nesting of adjacent blanks decreases the cost of manufacturing the paperboard container 10.

Referring to FIGS. 2 and 3, a pour spout outer closure layer 224 is formed in first side wall 20 and extends downwardly from the fold line 36 located beneath the major flap 12*b*. A top edge of the closure layer 224 is hingedly connected to the major flap 12*b* along the above described fold line 36. The combination of the closure layer 224 and plug 124 comprises the pour spout closure 24.

As depicted best in FIG. 3, two sides of the closure layer 224 extend downwardly from the fold line 36 and taper slightly inwardly until reaching a horizontal fold line 137. Upon reaching the horizontal fold line 137, the two sides of the closure layer 224 proceed to extend downwardly. The shape of one side of the closure layer 224 results in a formation of one nipple or prong 260 in the first side wall 20 adjacent to the closure layer 224. As depicted in FIG. 3, the prongs 260 are straight-edged. However, the prongs 260 may be angled. As discussed in more detail below, the prongs 260 are sized to assist in retaining the pour spout closure 24 in a closed position (see FIG. 10). A bottom side of the closure layer 224 is formed in the side wall 20 when the two sides generally flatten out horizontally at point 230. The prongs 260, as depicted in FIGS. 7–10, are located near a bottom side of the plug 124 when the pour spout closure 24 is in the closed position. However, the prongs 260 may be located in other positions relative to the plug 124, as long as the prongs 260 assist in retaining the plug 124 in covering of an opening or hole 300 (see FIGS. 7–10). It is contemplated that the sides of the closure layer 224 may be of various shapes.

The closure layer 224 is initially connected to a remainder of the side wall 20 by two die-cut lines 128. Die-cut lines 128 may contain weakening "nicks" whereby the closure layer 224 can be easily separated from the remainder of the side wall 20. As depicted best in FIG. 3, the horizontal fold line 137 bridges the two die-cuts 128 at a lower point of the prongs 260. Horizontal fold line 137 assists in reinserting the plug 124 into the opening 300. A moon-shaped cutout 140 is formed in the side wall 20 and is adjacent to a grab tab 142 of the closure layer 224 in FIG. 3. Cutout 140 assists a consumer in easily grasping a bottom end of the grab tab 142. The grab tab 142 (as depicted in FIG. 9) assists the consumer in opening and closing the pour spout closure 24.

After the blank is formed, the blank is folded and glued to form the paperboard container 10. As depicted in FIGS.

2 and 3, the U-shaped section 138 has the foot or extension 210 located near a top end thereof. The foot 210 assists in aligning the plug 124 with its counterpart, the pour spout closure layer 224, during the folding sequence. When the backboard 202 is folded about 180 degrees inwardly relative to the first side wall 20 (see FIG. 4), a left edge of the foot 210 will initially be located on or slightly to the right (as viewed in FIG. 2) of the vertical fold line 34 connecting the side wall panels 16 and 20. To assist in locating the foot 210 as described above, a fold line 152 may be slightly skewed or offset. In addition, an area located above a top edge 221 of the connector panel 220 may be cut away in order to assist in locating the foot 210. The foot 210 will be located in its final position (see FIG. 4) when the side wall 16 is folded approximately 90 degrees inwardly relative to the first side wall 20 during the formation of the rectangular, tubular body (see FIGS. 5 and 6). The above described folding of the side wall 16 will move the foot 210 to the right of vertical fold line 34 to its final position (see FIG. 4) before the adhesive is set. At its final position, the plug 124 is aligned with its counterpart, pour spout layer 224. It is contemplated that the foot 210 may be formed at other locations of section 138 so as to assist in aligning the plug 124 with the pour spout closure layer 224. Other folding sequences are contemplated with different blanks to align the plug 124 with the pour spout closure layer 224 and at least one prong 260. One example is a backboard (which includes a closure layer) being folded about 180 degrees outwardly relative to a side wall (which includes a detachable plug) so that the closure layer and plug are aligned relative to at least one prong.

Figure 4:
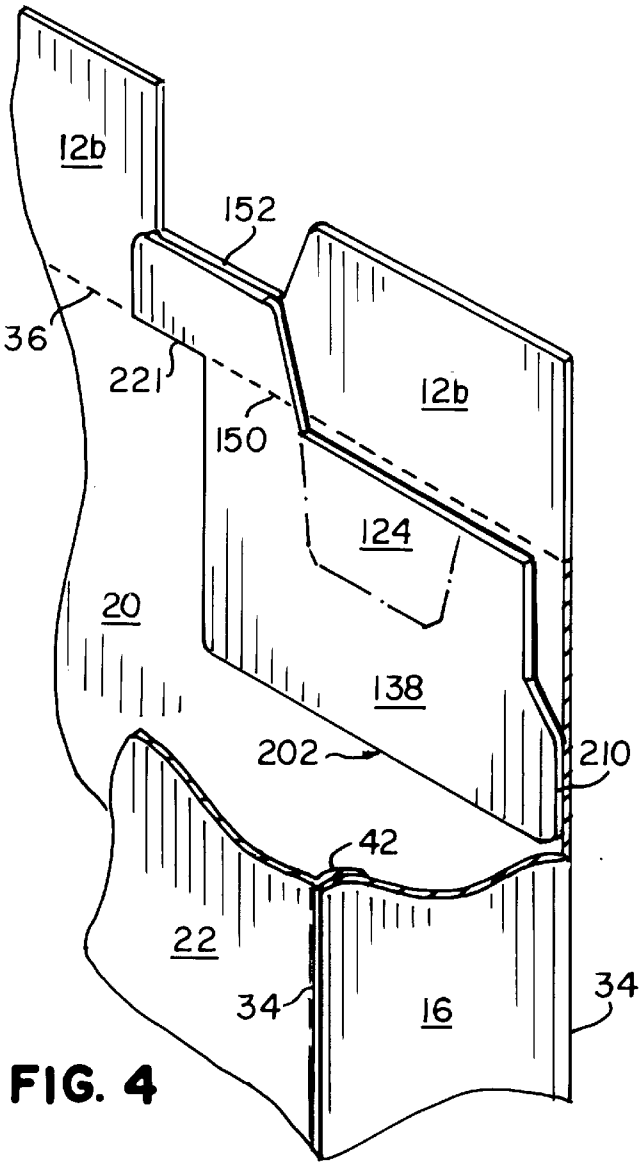
FIG. 4 is an enlarged partial interior isometric view showing the pour spout closure formed from the pour spout forming portion in FIG. 3.

FIG. 4 depicts the pour spout closure 24 formed from the pour spout forming portions depicted in FIG. 3. In the description below, the "inner surface" of a particular element refers to the portion of the inside surface of the blanks in FIG. 2 that contains that element. To realize the pour spout closure 24 in FIG. 4, the backboard 202 is folded downwardly and inwardly by about 180 degrees along fold line 152 relative to the side wall 20. The inner surface of the section 138 of the backboard 202 is adhered to the inner surface of the side wall 20, and the inner surface of the closure layer 224 (hidden in FIG. 4) is adhered to the inner surface of the plug 124. The horizontal score line 150 is preferably aligned with horizontal fold line 36 in order to facilitate the forming of the top wall 12. To prevent spillage or sifting, the inner surface of the backboard 202, when folded, extends downwardly as shown in FIG. 4 so as to cover the cutout 140.

Figure 5:
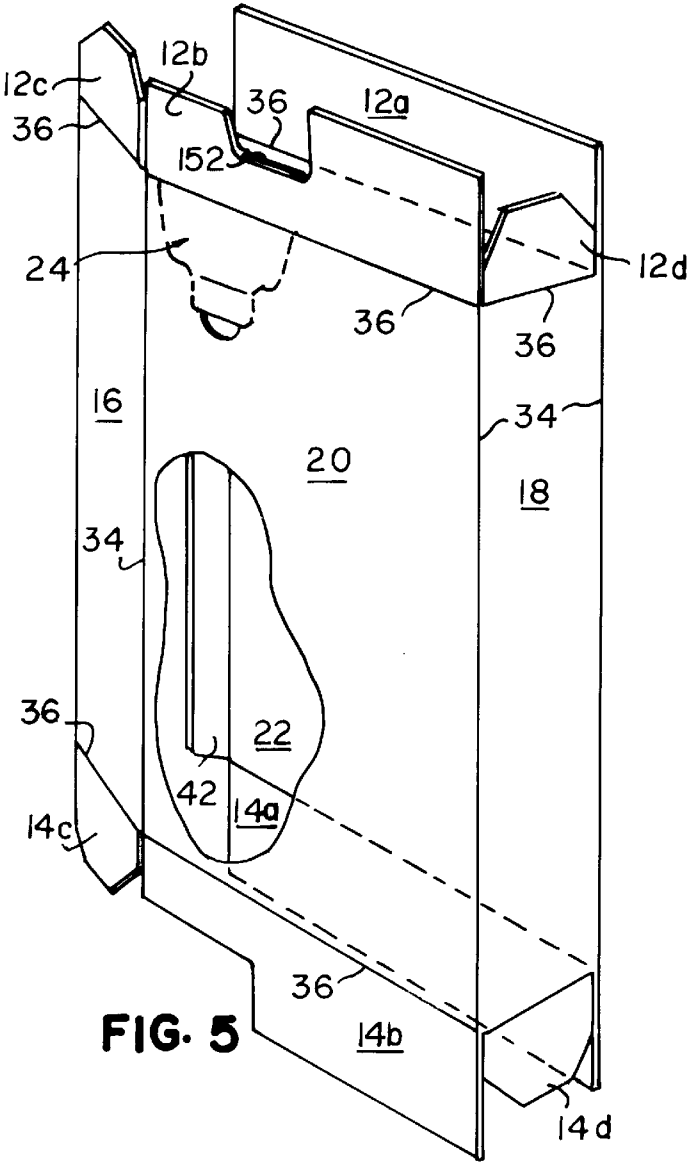
FIG. 5 is a perspective view showing the blank in FIG. 2 being folded into a tubular form after forming the pour spout closure.

After folding and gluing the backboard 202 as depicted in FIG. 4, the blank is folded and glued in conventional fashion to form the paperboard container 10. Referring to FIG. 5, adhesive is applied to an outer surface of the glue flap 42. Next, the blank is folded about the vertical fold lines 34 to adhere the outer surface of the glue flap 42 to the inner surface of the side wall panel 16 along its free vertical edge. After the glue flap 42 is adhered to the side wall panel 16, the blank is in tubular form with open top and bottom ends.

Typically, the blank in tubular form is flattened (not shown) to permit stacking of the blank in a case along with other identical flattened blanks by hand or by using high-speed case packing equipment. After the case is shipped to a customer for form-fill-seal operations, the blank in flattened tubular form is stacked once again with other such blanks in the hopper of the form-fill-seal equipment. The hopper of the form-fill-seal equipment delivers the flattened tubular blank to a machine which erects the flattened blank into a rectangular body with open top and bottom ends. One of the open ends is then sealed by appropriately folding and gluing the major and minor flaps of that end. For example, to realize the sealed bottom wall 14 in FIG. 6, the major and minor flaps of that bottom wall are appropriately folded and glued.

After sealing one end (e.g., the bottom end) of the paperboard container 10, the form-fill-seal equipment fills the container with a product via the open end (e.g., the top end) of the container. Referring to FIG. 6, the filled container is then sealed by appropriately folding and gluing the top major and minor flaps. In one embodiment, the top minor flaps 12*c* and 12*d* are first folded inward about the associated fold line 36 so that they are substantially perpendicular to the side wall 20. As depicted in FIG. 6, the major flap 12*b* and the connector panel 220 (hidden) are folded inward along fold line 150 and fold line 36 so that they are substantially perpendicular to side wall 16. The outer surface of connector panel 220 forms part of the top wall 12.

Next, the top major flap 12*a* is folded inward approximately 90 degrees about the associated fold line 36. The inner surface of the folded top major flap 12*a* is adhered to the outer surface of the flap 12*b*, thereby sealing the top wall 12 as depicted in FIG. 1. Other folding sequences are contemplated for sealing the top and bottom walls 12 and 14 of the container 10.

Figure 7:
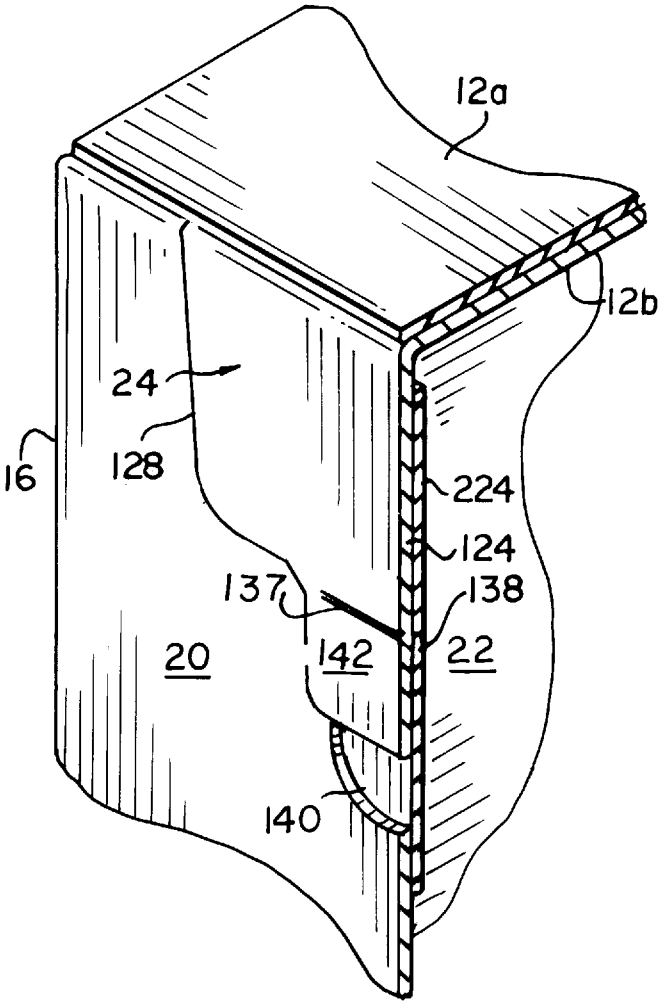
FIG. 7 is a partial isometric cross-sectional view of the paperboard container in FIG. 1 showing the non-directional paperboard pour spout in the closed position as viewed from the exterior of the container.

The pour spout closure 24 will now be described in detail with reference to FIGS. 1 and 7–10. Referring first to FIGS. 1 and 7, there is shown the non-directional pour spout closure 24 in its closed position. Prior to initially opening the pour spout closure 24, the narrow strip of paperboard encompassed by the die-cut lines 128 with weakening nicks is still intact. Since the container 10 is sift resistant (i.e. no gaps or spaces in which the contents of the container may escape), it is not necessary to adhere a peelable label to the side wall 20.

To initially open the pour spout closure 24, a user inserts his or her finger(s) into the cutout 140, engages the grab tab 142 of the closure layer 224, and pulls outwardly on the closure layer 224. In response to the application of a sufficient amount of opening force, the plug 124 and closure layer 224 are forced open. Since the inner surface of the closure layer 224 is adhered to the plug 124, the closure layer 224 and the plug 124 move in tandem with each other. During this opening process, the closure layer 224 breaks free from the surrounding portions of the side wall 20 and, at the same time, the plug 124 breaks free from the surrounding portions of the backboard 202. The plug 124 is then forced through the interfering prongs 260, and the pour spout closure 24 is moved to the open position. (see FIGS. 8 and 9)

Figure 10:
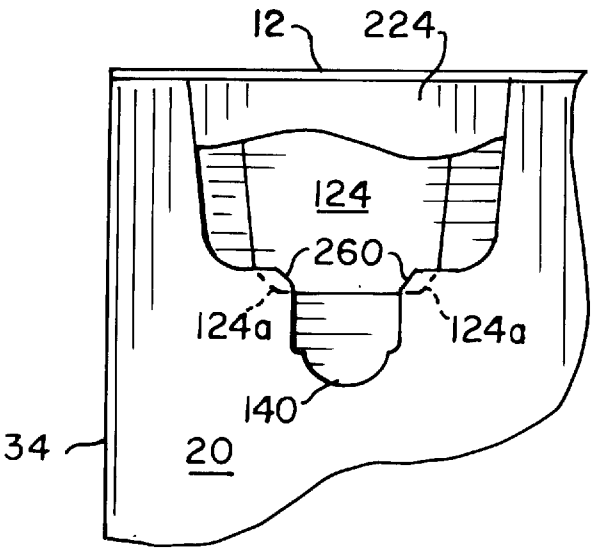
FIG. 10 is a partial front view of a side wall of the paperboard container in FIG. 1 showing the non-directional pour spout in the closed position.

After the user dispenses the desired amount of contents from the container 10, the pour spout closure 24 is reclosed to the closed position shown in FIG. 10 by pushing inwardly on the outer surface of the closure layer 224. To prevent the pour spout closure 24 from collapsing into the container 10 upon reclosure, the closure layer 224 is cut offset from the backboard 202 as depicted in FIGS. 8 and 9. Additionally, this offset cut between the closure layer 224 and the backboard 202 enhances the sift resistance of the container 10.

When moving the pour spout closure 24 to the closed position, the plug 124 is forced past the interfering prongs 260 and inserted into the opening 300 that was left behind by the plug 124 when the pour spout closure 24 was initially opened (see FIG. 10). More specifically, the periphery of the plug 124 "snaps" past the prongs 260, and the plug 124 is frictionally engaged inside the opening 300. The straight-edged prongs 260 assist in increasing the audible interaction between prongs 260 and the plug 124. As depicted in FIG. 10 with the pour spout layer 224 cut away, portions 124*a* of the plug 124 are covered by the interfering prongs 260 when the pour spout closure 24 is in the closed position. In order to extend the plug 124 further into the opening 300, the closure layer 224 may be provided with a debossment or indentation (not shown) in an area to which the plug 124 is attached. Details concerning the use of debossments on paperboard containers are disclosed in U.S. Pat. No. 5,439,133, which is incorporated herein by reference.

The snap re-engagement of the plug 124 provides tactile and audible feedback indicative of effective reclosure of the pour spout closure 24. It has been determined in this regard that the presence of such tactile and audible feedback indicative of effective locking is desirable because the presence thereof provides users with a high "comfort" factor with respect to reclosure. Particularly in applications where the pour spout closure 24 of the container 10 has been initially opened with a product having a restricted storage life, such positive feedback has been determined to provide an apparent sense of reassurance to users as to retention of "freshness", "safety", or scent of the contained product.

As shown in FIG. 4, the backboard 202 substantially overlaps and is adhered to an inner surface of the side wall 20. Therefore, as the pour spout closure 24 is pivoted between the closed position and the open position (see FIGS. 7 and 8), the closure panel 224 and plug 124 move in tandem with each other. The overlapping layers of paperboard provided by the closure panel 224 and backboard 202 enhance the durability of the pour spout closure 24, thereby allowing the closure 24 to be repeatedly opened and closed without sustaining damage.

While the present invention has been described with reference to one or more particular embodiments, those skilled in the art will recognize that many changes may be made thereto without departing from the spirit and scope of the present invention. For example, the pour spout closure may be located on a top left portion of major flap 12*b*, instead of a top right portion of major flap 12*b* as depicted in FIG. 2. In addition, the pour spout closure may be located on either a top left portion or a top right portion of major flap 12*a*. Each of these embodiments and obvious variations thereof is contemplated as falling within the spirit and scope of the claimed invention, which is set forth in the following claims.

What is claimed is:

1. A paperboard container composed of a unitary, continuous blank, comprising:

opposing top and bottom walls and a plurality of side walls bridging said top and bottom walls, said plurality of side walls including a first side wall having upper and lower ends;

a top major flap extending from said upper end of said first side wall, said top major flap forming a portion of said top wall;

a backboard coupled to said top major flap and including a plug; and an outer closure layer formed in said first side wall and being adhered to said plug, said closure layer and said plug forming a pour spout closure, said pour spout closure being pivotally coupled to said first side wall for movement between a closed position and an open position, said plug being detachably linked to a remainder of said backboard such that said plug is linked to said backboard when said pour spout closure is initially in said closed position, said plug is detached from said remainder of said backboard and leaves behind a hole in response to moving said pour spout closure from said closed position to said open position, and said plug is inserted into said hole in response to moving said pour spout closure from said open position to said closed position, said first side wall forming at least one prong adjacent to said closure layer, said at least one prong engaging said plug in response to moving said pour spout closure from said open position to said closed position.

2. The paperboard container of claim 1 wherein said backboard further includes a foot to assist in aligning said plug with said outer closure layer.

3. The paperboard container of claim 1 wherein said remainder of said backboard has a generally inverted U-shape.

4. The paperboard container of claim 1 wherein said at least one prong in the first side wall is exactly two prongs.

5. The paperboard container of claim 1 wherein said at least one prong is straight-edged.

6. The paperboard container of claim 1 wherein said at least one prong is angled.

7. The paperboard container of claim 1 wherein at least one connector panel is hingedly connected to said backboard and said top major flap, said at least one connector panel forming part of said top wall.

8. The paperboard container of claim 7 wherein said at least one connector panel is exactly one connector panel, said connector panel having a top edge to assist in aligning said plug with said outer closure layer.

9. A paperboard container composed of a unitary, continuous blank, comprising:

opposing top and bottom walls and a plurality of side walls bridging said top and bottom walls, said plurality of side walls including a first side wall having upper and lower ends and inner and outer surfaces;

a top major flap extending from said upper end of said first side wall, said top major flap forming a portion of said top wall;

a backboard coupled to said top major flap, said backboard including a plug and having inner and outer surfaces, said inner surface of said backboard being adhered to said inner surface of said first side wall; and a closure layer formed in said first side wall and having inner and outer surfaces, said inner surface of said closure layer being adhered to said plug, said closure layer and said plug forming a pour spout closure, said pour spout closure being pivotally coupled to said first side wall for movement between a closed position and an open position, said plug being detachably linked to a remainder of said backboard such that said plug is linked to said backboard when said pour spout closure is initially in said closed position, said plug is detached from said remainder of said backboard and leaves behind a hole in response to moving said pour spout closure from said closed position to said open position, and said plug is inserted into said hole in response to moving said pour spout closure from said open position to said closed position.

10. The paperboard container of claim 9 wherein said first side wall forms at least one prong adjacent to said closure layer.

11. The paperboard container of claim 10 wherein said at least one prong engages said plug in response to moving said pour spout closure from said open position to said closed position.

12. The paperboard container of claim 11 wherein said at least one prong is exactly two prongs, each of said prongs being straight-edged.

13. The paperboard container of claim 11 wherein said at least one prong is exactly two prongs, each of said prongs being angled.

14. The paperboard container of claim 9 wherein said backboard further includes a foot to assist in aligning said plug with said outer closure layer.

15. The paperboard container of claim 9 wherein said remainder of said backboard has a generally inverted U-shape.

16. The paperboard container of claim 9 wherein at least one connector panel is hingedly connected to said backboard and said top major flap, said at least one connector panel forming a part of said top wall.

17. The paperboard container of claim 16 wherein said at least one connector panel is exactly one connector panel, said connector panel having a top edge to assist in aligning said plug with said outer closure layer.

18. A method of forming a pour spout closure in a paperboard container composed of a unitary, continuous blank, said container having opposing top and bottom walls and a plurality of side walls bridging said top and bottom walls, said plurality of side walls including a first side wall having upper and lower ends, said method comprising the steps of:

providing a top major flap extending from said upper end of said first side wall;

providing a backboard coupled to said top major flap, said backboard including a detachable plug and having inner and outer surfaces;

forming a closure layer in said first side wall, said closure layer having inner and outer surfaces;

folding said backboard inwardly toward an interior of said container;

adhering said inner surface of said backboard to said inner surface of said first side wall; and adhering said inner surface of said closure layer to said plug, said closure layer and said plug forming said pour spout closure.

19. The method of claim 18 wherein said step of folding said backboard further includes folding said backboard approximately 180 degrees relative to said first side wall.

20. The method of claim 18 wherein said pour spout closure is pivotally coupled to said first side wall for movement between a closed position and an open position, said detachable plug being linked to a remainder of said backboard such that said plug is linked to said backboard when said pour spout closure is initially in said closed position, said plug is detached from said remainder of said backboard and leaves behind a hole in response to moving said pour spout closure from said closed position to said open position, and said plug is inserted into said hole in response to moving said pour spout closure from said open position to said closed position.

21. The method of claim 20 further including the step of forming at least one prong in said first side wall adjacent to said closure layer, said at least one prong engaging said plug in response to moving said pour spout closure from said open position to said closed position.

22. A method of forming a pour spout closure in a paperboard container composed of a unitary, continuous blank, said container having opposing top and bottom walls and a plurality of side walls bridging said top and bottom walls, said plurality of side walls including a first side wall having upper and lower ends, said method comprising the steps of:

providing a top major flap extending from said upper end of said first side wall;

providing a backboard coupled to said top major flap and including a detachable plug;

forming a closure layer in said first side wall;

folding and adhering said backboard to said first side wall;

adhering said closure layer to said plug, said closure layer and said plug forming a pour spout closure, said pour spout closure pivotally coupled to said first side wall for movement between a closed position and an open position; and forming at least prong in said first side wall adjacent to said closure layer, said at least one prong engaging said plug in response to moving said pour spout closure from said open position to said closed position.

23. The method of claim 22 wherein said step of folding and adhering said backboard includes folding said backboard approximately 180 degrees relative to said first side wall.

24. The method of claim 22 wherein said at least one prong is exactly two prongs, each of said prongs being straight-edged.

25. The method of claim 22 wherein said at least one prong is exactly two prongs, each of said prongs being angled.

* * * * *